US005259816A

United States Patent [19]

Ke et al.

[11] Patent Number: 5,259,816

[45] Date of Patent: Nov. 9, 1993

[54] VENTILATING APPARATUS

[76] Inventors: Po C. Ke; Kuo T. Lai; Pang T. Lu; Ching C. Lai; Chia C. Liu, all of P.O. Box 82-144, Taipei, Taiwan

[21] Appl. No.: 885,042

[22] Filed: May 18, 1992

[51] Int. Cl.[5] ..... F24F 3/16; F24F 7/007

[52] U.S. Cl. ..... 454/244

[58] Field of Search ..... 454/241, 243, 244, 249, 454/104, 142, 48; 55/481; 422/124

[56] References Cited

U.S. PATENT DOCUMENTS 2,152,614 3/1939 Younger ..... 454/249 X
2,209,054 7/1940 Doud et al. ..... 55/473 X
2,856,836 10/1958 Spear ..... 454/349

FOREIGN PATENT DOCUMENTS 218747 9/1987 Japan ..... 454/292
231858 7/1944 Switzerland ..... 454/249

*Primary Examiner*—Harold Joyce
*Attorney, Agent, or Firm*—Alfred Lei

[57] ABSTRACT

A ventilating apparatus which includes a housing divided by a rib into an inlet passage, an outlet passage, and a chamber. A controlling system having a motor, a drawing fan, and an exhaust fan. A filter net inserted in a slot between the air inlet of the housing and the drawing fan. A cover having a flange is fixedly mounted on the top of the housing and a louver provided with a plurality of air outlets and a plurality of air inlets is mounted on the bottom side of the housing.

1 Claim, 7 Drawing Sheets

VENTILATING APPARATUS

BACKGROUND OF THE INVENTION

It is found that the conventional exhaust fan can be only used to exhaust air out of a room or draw fresh air into the room. Hence, such exhaust fan is unfit for use in a room without ventilator. Hence, when desired to supply fresh air to the user in a room without ventilator, it is necessary to buy another fan for drawing fresh air into the room thus causing much inconvenience and wasting much money.

Therefore, it is an object of the present invention to provide an improved a ventilating apparatus which may obviate and mitigate the above-mentioned drawbacks.

SUMMARY OF THE INVENTION

This invention relates to an improved ventilating apparatus.

It is the primary object of the present invention to provide a ventilating apparatus which may exhaust air out of the room and draw fresh air into the room at the same time.

It is another object of the present invention to provide a ventilating apparatus which may supply fresh air with fragrant scent.

It is still another object of the present invention to provide a ventilating apparatus which is fit for use in a room without ventilator.

It is still another object of the present invention to provide a ventilating apparatus which is simple in construction.

It is a further object of the present invention to provide a ventilating apparatus which is facile to assemble.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
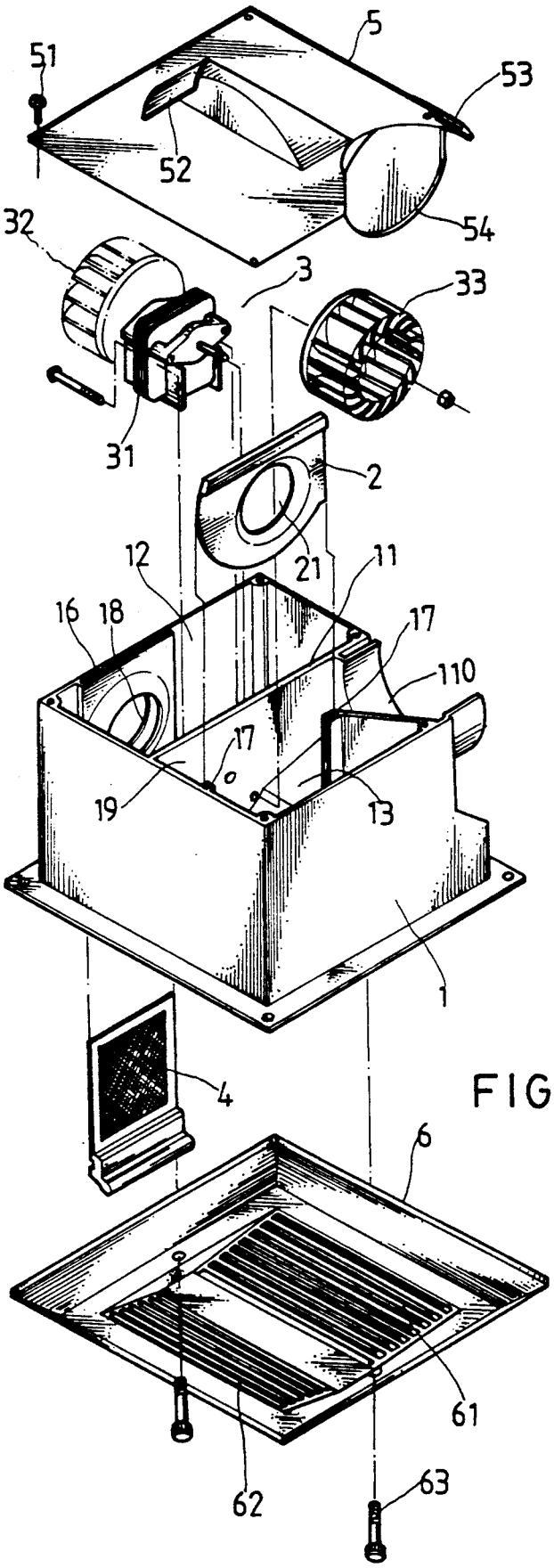
FIG. 1 is an exploded view of a ventilating apparatus according to the present invention.
Figure 2:
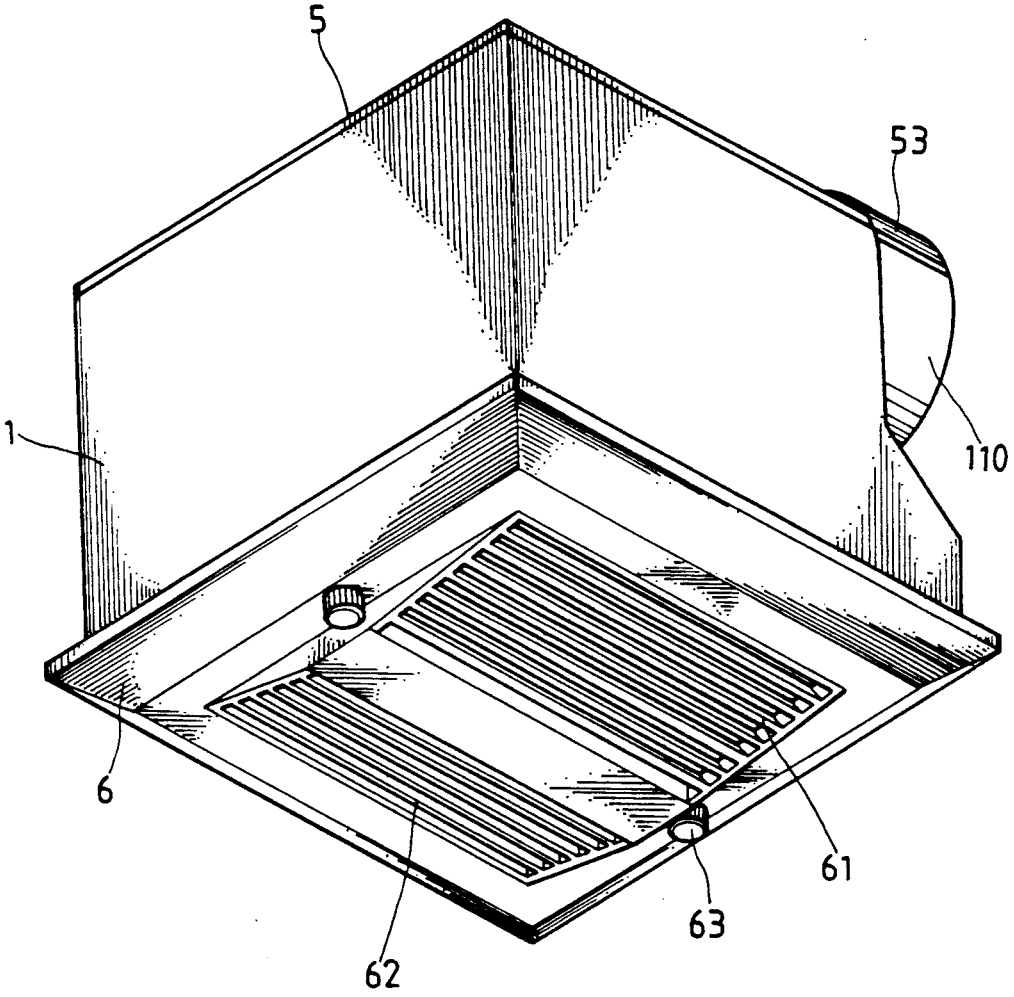
FIG. 2 is a perspective view of the ventilating apparatus according to the present invention.
Figure 3:
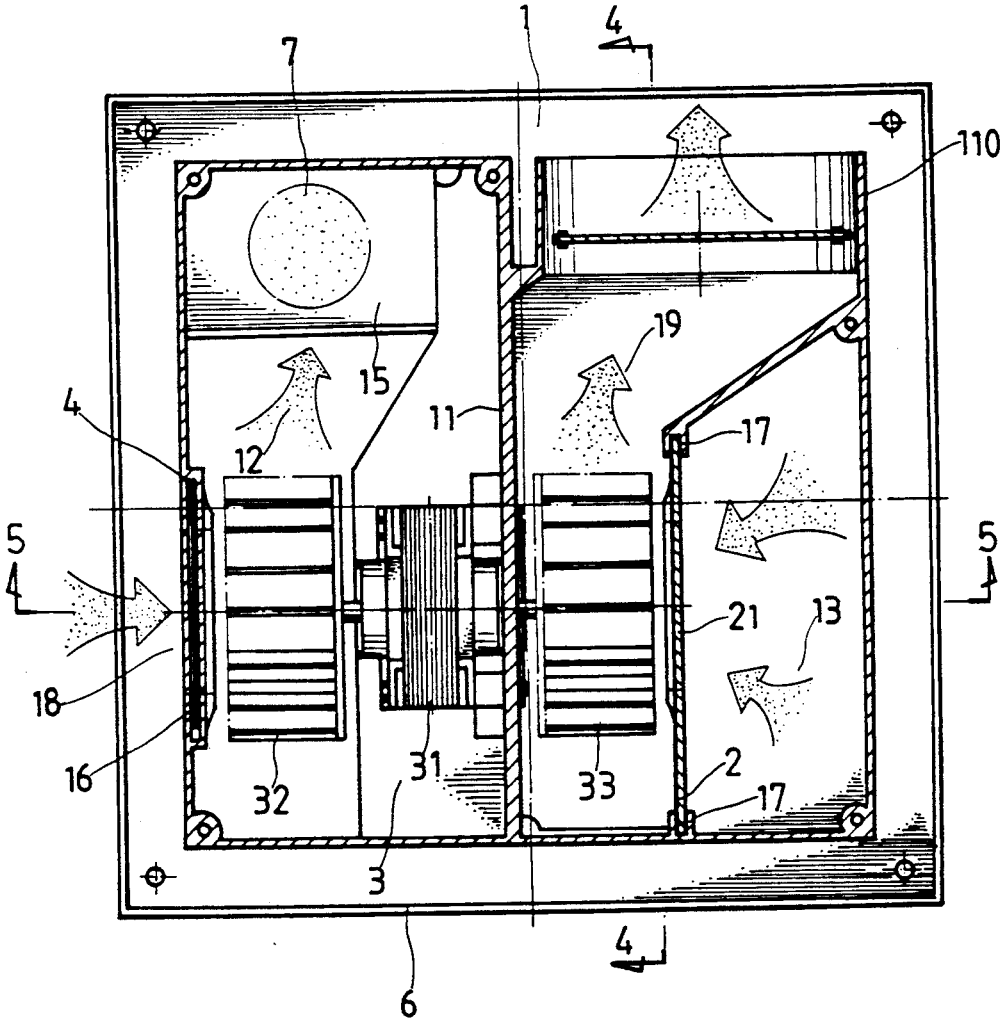
FIG. 3 is a sectional view of the present invention.
Figure 4:
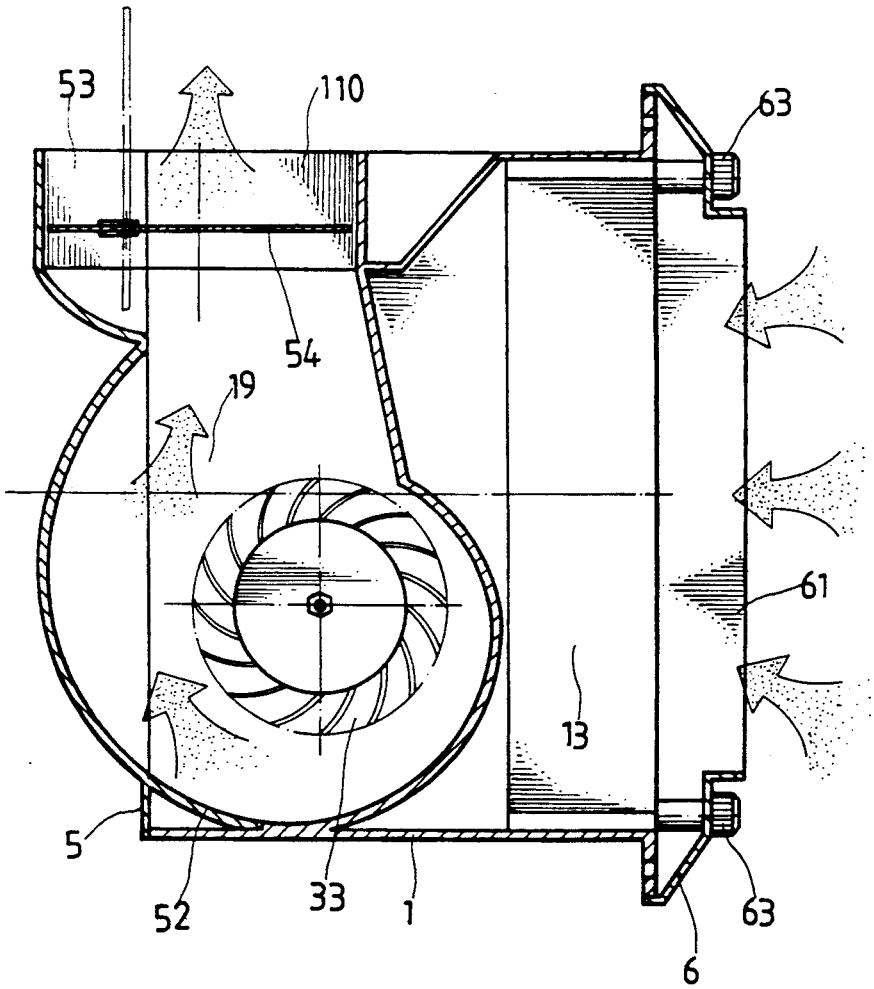
FIG. 4 shows the working principle of the present invention.
Figure 5:
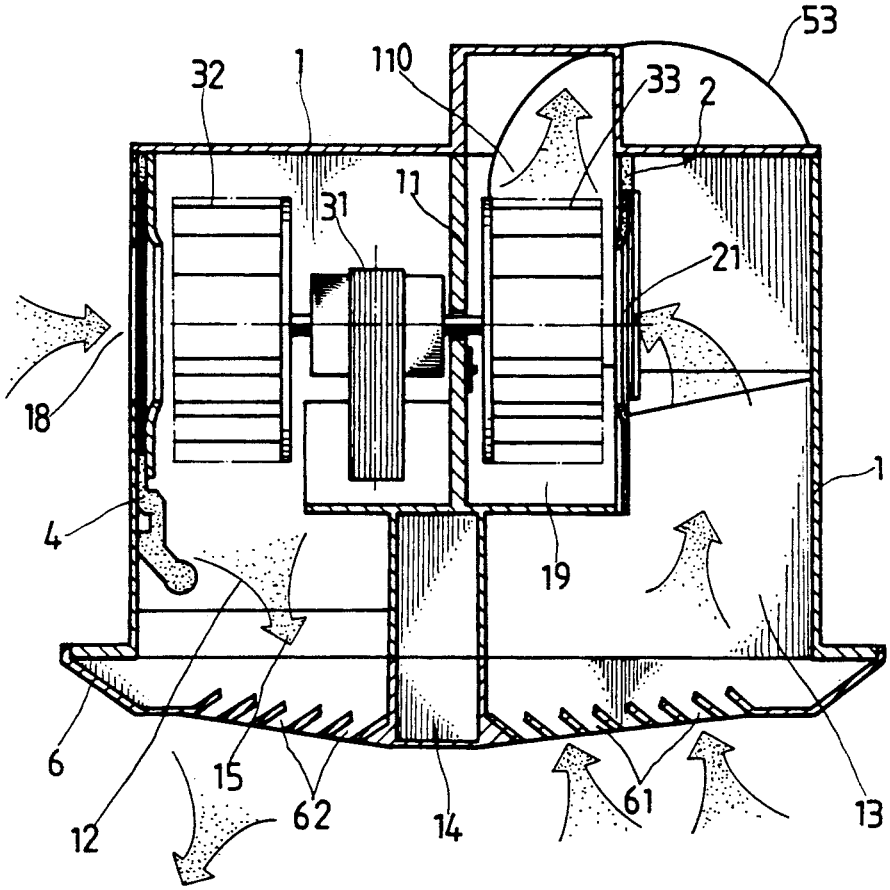
FIG. 5 shows the working principle of the present invention.

With reference to the drawings and in particular to FIGS. 1 and 2 thereof, the present invention mainly comprises a housing 1, a guide plate 2, a controlling system 3, a filter net 4, a cover 5 and a louver 6.

The housing 1 is provided with a rib 11 dividing it into an inlet passage 12, an outlet passage 13 and a chamber 14. The inlet passage 12 has a supporting frame 15 for mounting a solid fragrant agent 7 and a slot 16 for fitting the filter net 4. The outlet passage 13 has a slot 17 for receiving the guide plate 2 and an involute passage 19.

The guide plate 2 is formed with a hole 21 and inserted in the slot 17 of the outlet passage 13.

The controlling system 3 includes a motor 31, a drawing fan 32, and an exhaust fan 33.

The filter net 4 is inserted in the slot 16 between the air inlet 18 and the drawing fan 32.

The cover 5 is fixedly mounted on the top of the housing 1 by screws 51 and having a flange 53 at one side under which there is a valve gate 54.

The louver 6 is provided with a plurality of air outlets 61 and a plurality of air inlets 62 and mounted on the bottom side of the housing by bolts 63.

As the motor 31 is turned on, the drawing fan 32 and the exhaust fan 33 will be actuated at the same time thereby filtering the air and rendering it a fragrant scent.

In installation, the housing 1 may be concealed behind the ceiling or wall so that only the louver 6 can be observed from outside. As the power is turned on, the motor 31 will be actuated to drive the drawing fan 32 and the exhaust fan 33 thereby sucking in air from outside through the filter net 4. Then the cleaned air will flow through the air inlets 62 of the louver 6 via the inlet passage 12 into the room. In the meantime, the fragrant scent from the solid fragrant agent 7 will flow into the room along with the cleaned air. Further, the exhaust fan 33 will draw out air in the room through the air outlet 61 of the louver 6 and exhaust the air through the outlet passage 13, the hole 21 of the guide plate 2, the involute passage 19 and the exhaust pipe 110 of the housing 1.

Figure 6:
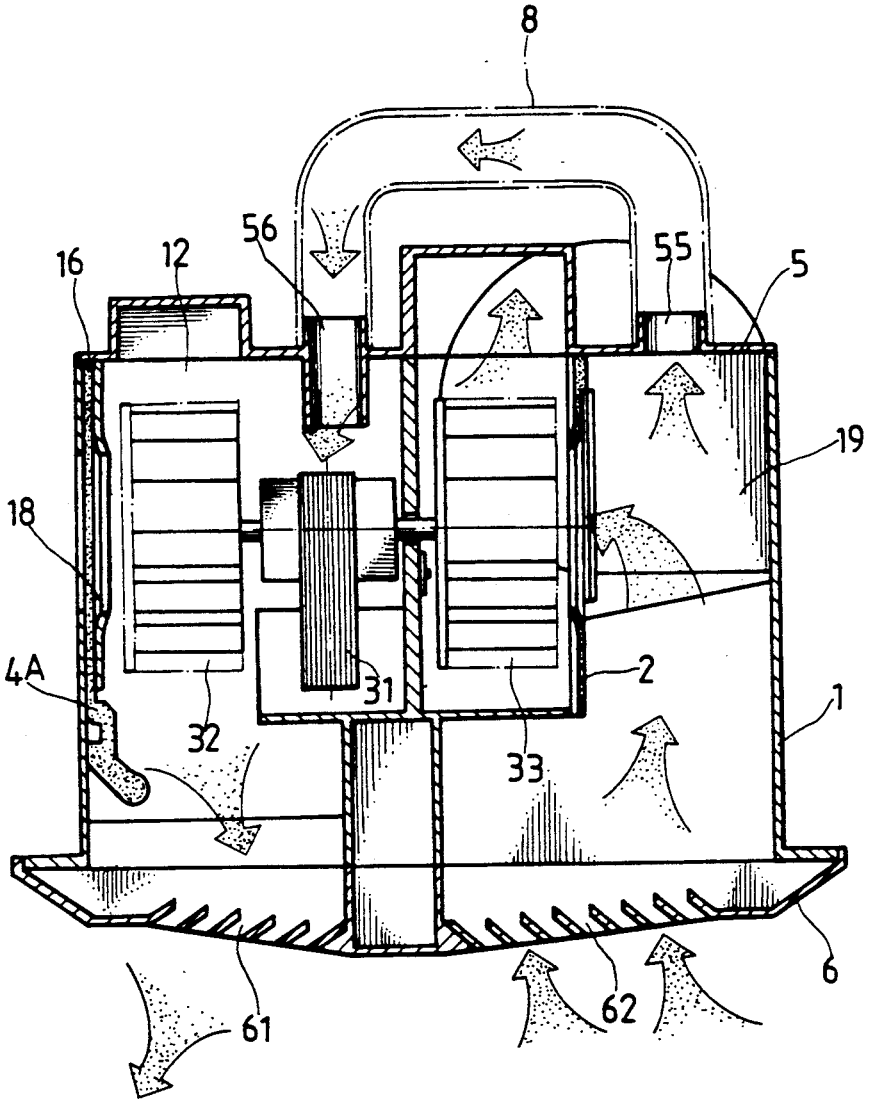
FIG. 6 is a sectional view of a second preferred embodiment according to the present invention.
Figure 7:
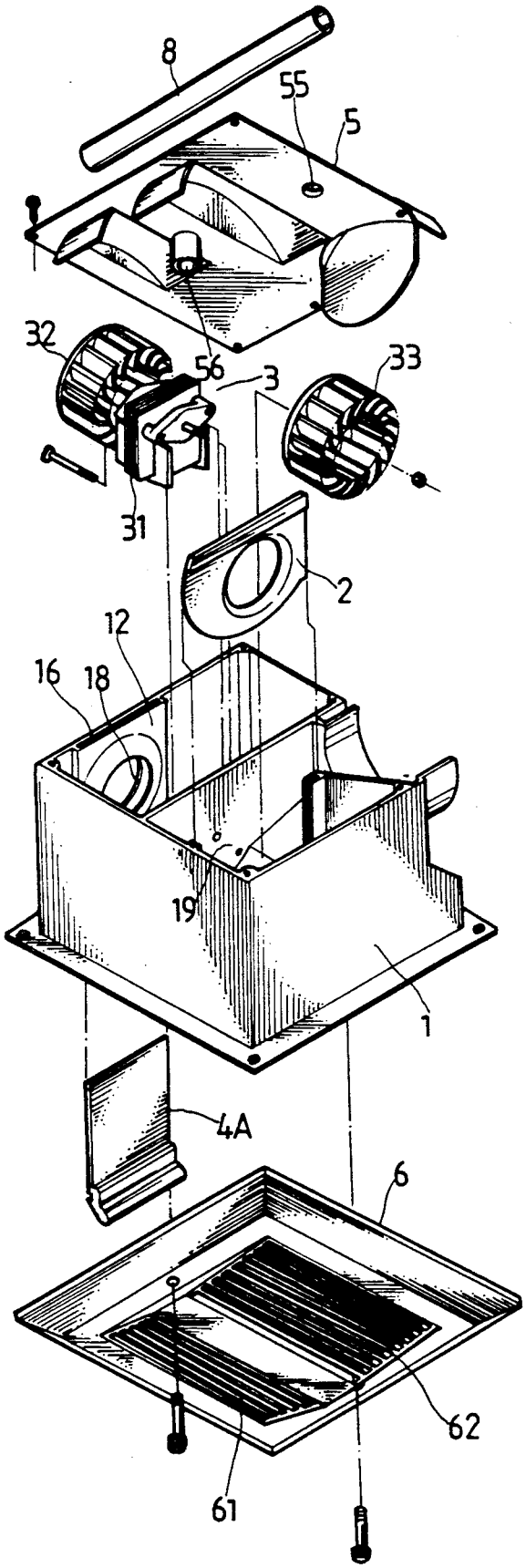
FIG. 7 is an exploded view of the second preferred embodiment according to the present invention.

FIGS. 6 and 7 show another preferred embodiment of the present inveniton. As illustrated, the filter net 4 inserted in the slot 16 between the air inlet 18 of the housing 1 and the drawing fan 32 may be replaced with an engaging plate 4A. In addition, the cover 1 is formed with an air inlet hole 55 above the involute passage 19 and an air outlet hole 56 above the inlet passage 12 so that the drawing fan 32 will cause the air in the involute passage 19 to go into the inlet passage 12 via a hose 8 thereby enabling the fragrant scent from the solid fragrant agent to circulate with the air in the room.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

We claim:

1. A ventilating apparatus for mounting in the ceiling of a room for air flow into and from the room comprising:

a housing having a top cover, side walls, and an open bottom, the housing being divided by a rib into an inlet passageway and an outlet passageway;

a solid fragrant agent and a filter net, said inlet passage having a supporting frame for mounting the solid fragrant agent and a slot for inserting the filter net;

a guide plate being formed with a hole therein, said guide plate being inserted in a slot in said outlet passageway;

a controlling system having a motor for driving a drawing fan and an exhaust fan, said drawing fan being located in the inlet passageway and said exhaust fan being located in the outlet passageway;

the filter net being inserted in the slot between an air inlet of said housing and said drawing fan, and the guide plate being inserted in the slot adjacent the upstream side of the exhaust fan;

the cover having a downwardly depending flange for mounting to the side walls of the housing; and a louver plate having a plurality of louvers being mounted on the open bottom of the housing whereby the air flow will be controlled.

* * * * *